US005938410A

United States Patent [19]

Lee

[11] Patent Number: 5,938,410

[45] Date of Patent: Aug. 17, 1999

[54] DUST SUCKING/BLOWING DEVICE

[76] Inventor: Jeen-Ju Lee, 2nd Floor, No. 3, Lane 50, Song-Ping Road, Taipei City, Taiwan

[21] Appl. No.: 08/906,902

[22] Filed: Aug. 6, 1997

[51] Int. Cl.[6] ..... F04B 53/00; A47L 5/00; A47L 5/24

[52] U.S. Cl. ..... 417/234; 417/423.2; 417/315; 15/330; 15/344

[58] Field of Search ..... 417/234, 423.2, 417/315; 15/328, 330, 344

[56] References Cited

U.S. PATENT DOCUMENTS

| | | | |
|---|---|---|---|
| D. 277,516 | 2/1985 | Hayden et al. | D32/18 |
| 3,647,323 | 3/1972 | Thomas | 417/234 |
| 4,042,999 | 8/1977 | Triantafyllou | 15/422 |
| 4,663,799 | 5/1987 | Kiyooka | 15/330 |
| 4,817,230 | 4/1989 | Kiyooka | 15/330 |
| 5,267,372 | 12/1993 | Jones | 15/344 |
| 5,659,920 | 8/1997 | Webster et al. | 15/344 |
| 5,735,644 | 4/1998 | Grosswiller et al. | 417/315 |

*Primary Examiner*—Charles G. Freay
*Assistant Examiner*—Paul L. Ratcliffe
*Attorney, Agent, or Firm*—Rosenberg, Klein & Bilker

[57] ABSTRACT

A dust sucking/blowing device including a housing including a fan chamber for receiving a fan therein, a dust collecting sleeve fitted around the fan chamber and formed with a first and a second inlets communicating with a dust collecting room which is formed with at least one perforation for communicating with the incoming compartment of the chamber. The sleeve is further formed with an outlet for communicating with the outgoing compartment of the fan chamber. A control guide cartridge includes a hollow cartridge body formed with an inlet section fitted with the outlet of the sleeve for guiding air flow into the cartridge body, and an outlet for outward guiding the air flow from the cartridge body. When the outlet of the cartridge body is aligned with the fitting hole of the second casing, the outlet of the cartridge body permits the air flow from the fan to be outward blown from the passage of the dust sucking/blowing tube fitted with the fitting hole for blowing away dusts. When the guide sleeve is aligned with the first inlet of the sleeve and the fitting hole of the second casing, the external dusts and impurities are sucked through the passage, guide sleeve and the first inlet into the dust collecting room.

5 Claims, 6 Drawing Sheets

DUST SUCKING/BLOWING DEVICE

BACKGROUND OF THE INVENTION

The present invention relates to a dust sucking/blowing device which switchably serves to both suck and blow off dusts.

Numerous fine powders and dusts accumulate on the corners or in the fissures or attach to articles. It is impossible to clean up such powders and dusts with conventional cleaning tool. Therefore, a dust sucking device is used to suck off the powders and dusts. The existing device solely has one function such as sucking the dust or blowing off the dust.

In addition, the existing dust sucking or blowing device has large volume and cannot be easily carried or used in a narrow site.

SUMMARY OF THE INVENTION

It is therefore a primary object of the present invention to provides dust sucking/blowing device which easily switchably serves to both suck and blow off dusts. The dust sucking/blowing device has small volume and thus can be widely used in narrow sites.

The present invention can be best understood through the following description and accompanying drawings, wherein:

DETAILED DESCRIPTION OF THE PREFERRED EMBODIMENTS

Figure 1:
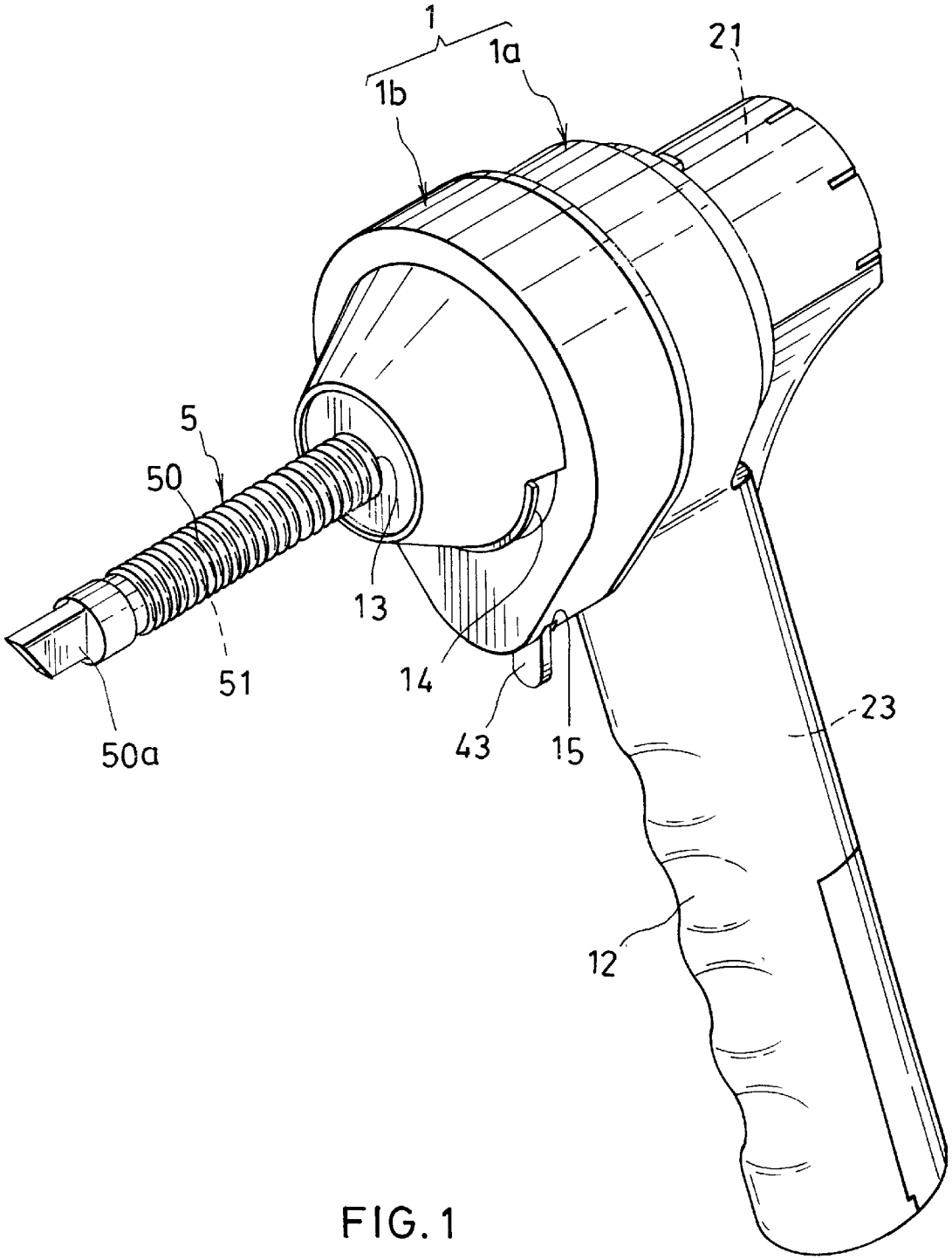
FIG. 1 is a perspective assembled view of the present invention.
Figure 2:
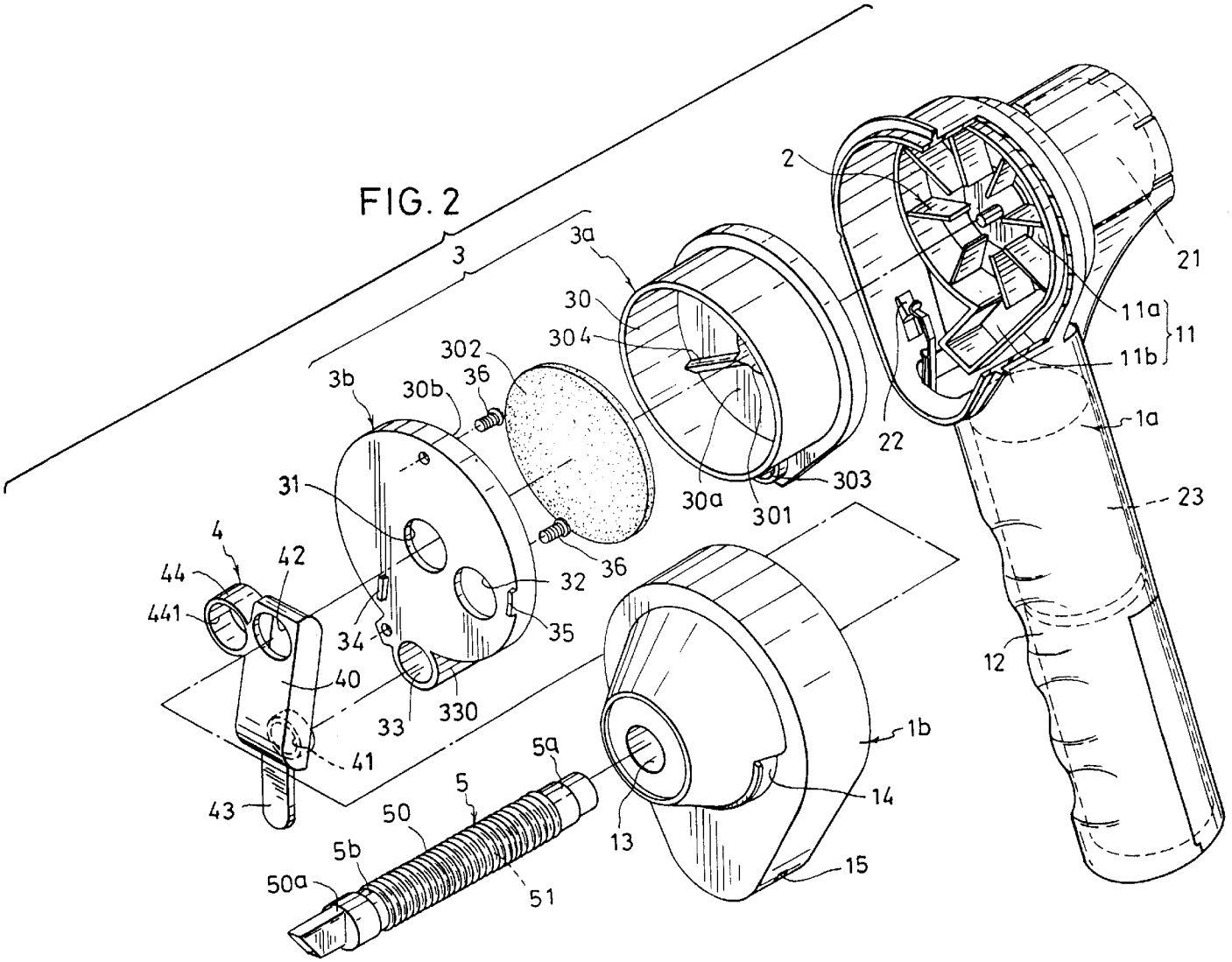
FIG. 2 is a perspective exploded view of the present invention.

Please refer to FIGS. 1 to 6. The dust sucking/blowing device of the present invention includes: a housing 1 defining a fan chamber 11 for receiving a fan 2 therein; a dust collecting sleeve 3 fitted around the fan chamber 11 and formed with at least a first and a second inlets 31, 32 and an butlet 33, the first and second inlets 31, 32 communicating with an inner dust collecting room 30 of the sleeve 3, the dust collecting room 30 being formed with a through hole 301 communicating with an incoming compartment 11*a* of the chamber 11, the outlet 31 communicating with an outgoing compartment 11*b* of the chamber 11; and a control guide cartridge 4 including an inlet section 41 stably fitted with the outlet 33 of the sleeve 3 for guiding the air flow created by the fan 2 to flow out of an air exit 42 of the guide cartridge 4. The guide cartridge 4 is connected with a guide sleeve 44. A dust sucking/blowing tube 5 having a passage 51 is fitted with the housing 1. The guide cartridge 4 can be eccentrically rotated about the inlet section 41 to align the guide sleeve 44 with the passage 51 and the first inlet 31 of the dust collecting sleeve 3 so as to seal the second inlet 32, the fan 2 is rotated to suck external powders, dusts or dirts through the passage 51 into the sleeve 3. On the other hand, the guide cartridge 4 can be rotated to align the air exit 42 with the passage 51 to blow air outward.

The housing 1 include's a first casing 1*a* defining the fan chamber 11 and having a downward extending handle 12, and a second casing 1*b* fitted with the first casing 1*a* and formed with a fitting hole 13 for receiving therein the dust sucking/blowing tube 5. The second casing is also formed with a ventilation hole 14 for ventilating the housing 1.

The fan 2 is driven by a rotary shaft of a driving motor 21 disposed in the housing 1 and controlled by a power switch 22. The driving motor 21 is connected to a cell 23 in the handle 12, which is serially connected to the power switch 22, whereby the power switch 22 can turn on/off the driving motor 21.

The dust collecting sleeve 3 includes a sleeve section 3*a* having a first end fitted around the chamber 11 for enclosing the fan 2 and a second end formed with a dust collecting room 30. The inner side of the room 30 is disposed with a side wall 30*a* for isolating the room 30 and the chamber 11. The side wall 30*a* is formed with at least one perforation 301 for communicating with the incoming section 11*a* of the chamber 11. A filter material 302 is disposed over the perforation 301 for filtering the dust and impurities sucked into the room 30. The outer side of the room 30 is formed with a through hole 303 aligned with and communicating with the outgoing section 11*b* of the chamber 11. The sleeve 3 further includes a cover body 3*b* having a first side formed with a fitting cavity 30*b* for fitting with the outer exit of the room 30. The cover body 3*b* is formed with a first inlet 31 and a second inlet 31, 32 for communicating with the chamber 30. The first inlet 31 is axially aligned with the fitting hole 13 of the second casing 1*b*. An air exhausting guide shaft 330 projects from a lateral side of the cover body 3*b* to axially pass through an outlet 33 and fit into the through hole 303 of the sleeve section 3*a* for outward guiding the air flow from the outgoing section 11*b*.

The side wall 30*a* of the sleeve section 3*a* is disposed with multiple ribs 304 over which the filter material 302 is disposed. The cover body 3*b* is locked on the second casing 1*b* by screws 36 to locate the sleeve 3 therein.

The control guide cartridge 4 includes a hollow cartridge body 40. A first end of the cartridge body 40 is disposed with an inlet section 41 communicating with the interior of the cartridge body 40 and fitted with the outlet 33 of the sleeve 3 for guiding air flow into the cartridge body 40. A second end of the cartridge body 40 is formed with an outlet 42 for outward guiding the air flow from the cartridge body 40. The guide cartridge 4 further includes a driving plate 43 one end of which is connected with the cartridge body 40 and the other end of which is passed through and out of a slide slot 15 of the housing 1 for a user to shift and rotate the guide cartridge 4. A guide sleeve 44 is connected with a lateral edge of the cartridge body 40 and formed with a guide hole 441.

Figure 3:
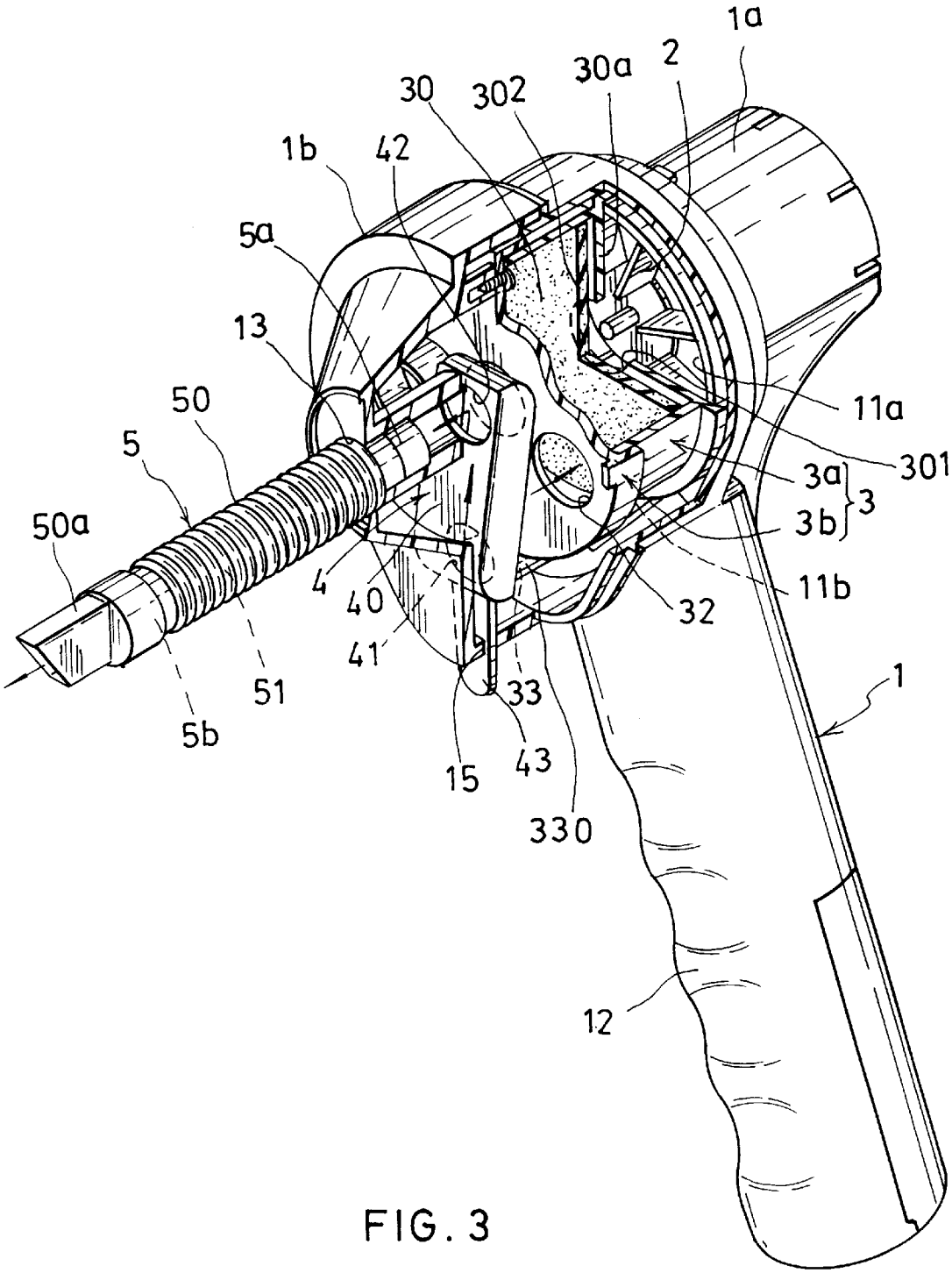
FIG. 3 is a perspective partially sectional view of the present invention in a dust blowing state.
Figure 4:
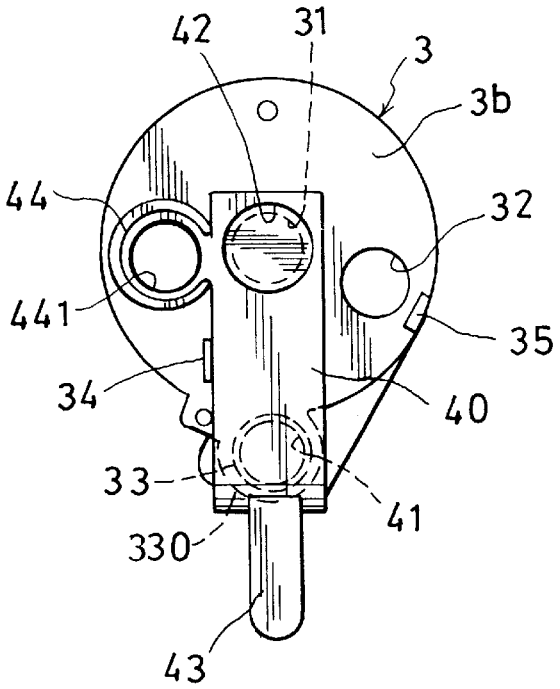
FIG. 4 shows the relationship between the dust collecting sleeve and the control guide cartridge in the dust blowing state.
Figure 5:
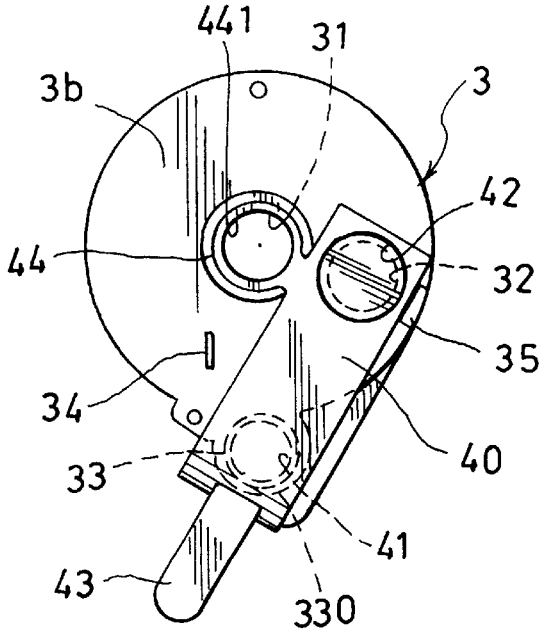
FIG. 5 shows the relationship between the dust collecting sleeve and the control guide cartridge in the dust sucking state.
Figure 6:
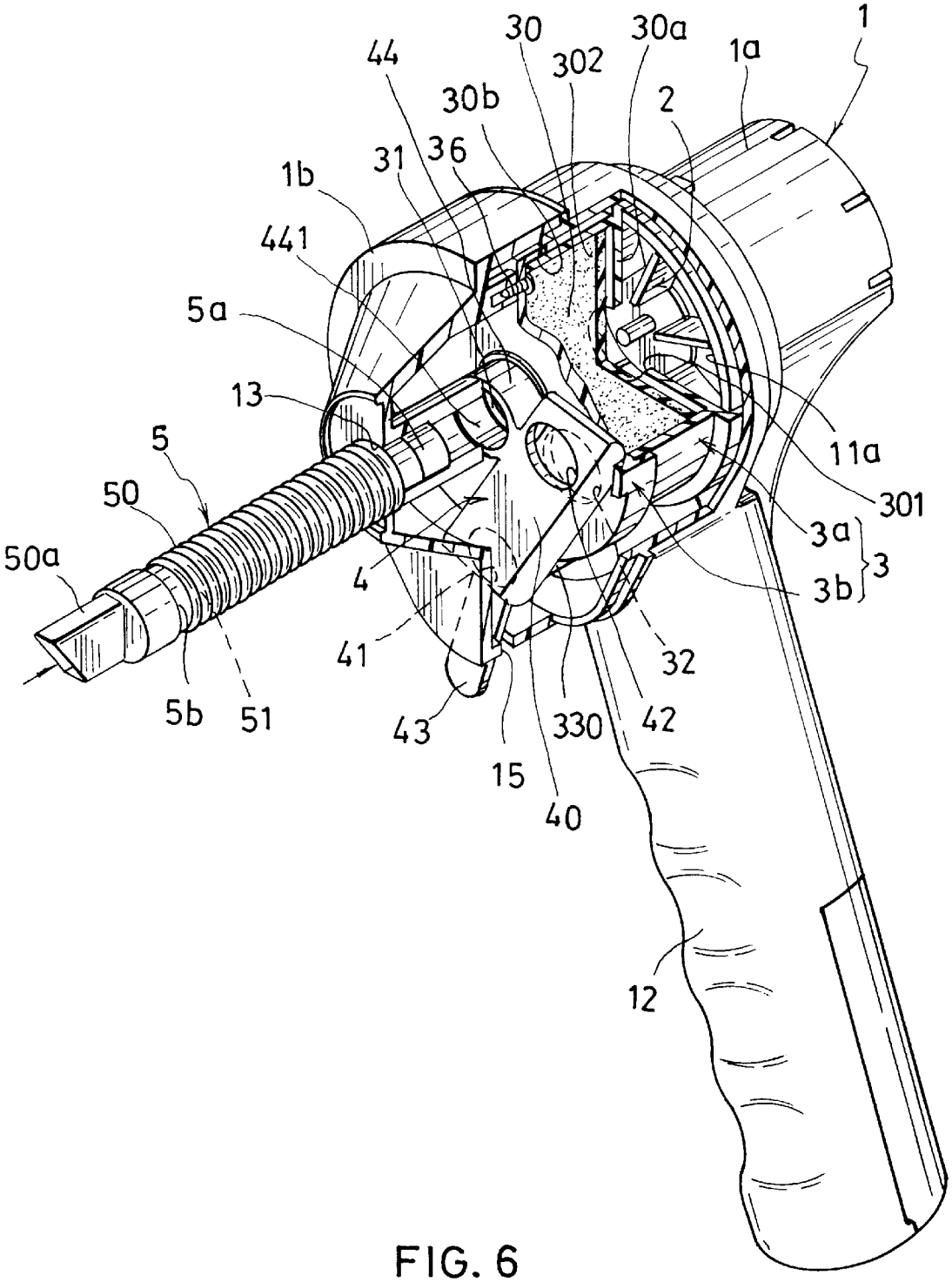
FIG. 6 is a perspective partially sectional view of the present invention in a dust sucking state.

A first side of the cartridge body 40 is attached to the outer side of the cover body 3*b* and is rotatable about the inlet section 41 via the driving plate 43. When the outlet 42 of the cartridge body 40 is aligned with the fitting hole 13 of the second casing 1*b* as shown in FIGS. 3 and 4, the outlet 42 of the cartridge body 40 permits the air flow from the fan 2 to be outward blown from the passage 51 of the dust sucking/blowing tube 5 fitted with the fitting hole 13 for blowing away dusts. Alternatively, the guide sleeve 44 can be aligned with the first inlet 31 of the sleeve 3 and the fitting hole 13 of the second casing 1*b* as shown in FIGS. 5 and 6, the first end of the cartridge body 40 seals the second inlet 32, whereby the first inlet 31 is communicated with the passage 51 of the dust sucking/blowing tube 5 via the guide hole 441 of the guide sleeve 44. Accordingly, when the fan 2 is rotated, the external dusts and impurities are sucked through the passage 51, guide sleeve 44 and the first inlet 31 into the room 30.

The cover body 3*b* of the dust collecting sleeve 3 is disposed with a first and a second locating stopper blocks 34, 35. When the guide cartridge 4 abuts against the first locating stopper block 34, the outlet 42 of the guide cartridge 4 is aligned with the passage 51 of the dust sucking blowing tube 5 as shown in FIGS. 3 and 4. Alternatively, when the guide cartridge 4 abuts against the second locating stopper block 35, as shown in FIGS. 5 and 6, the cartridge body 40 seals the second inlet 32 of the sleeve 3 and the guide hole 441 of the guide sleeve 44 is aligned with the passage 51 and the second inlet 32 as well as the first inlet 31 in a dust sucking state.

When used for blowing dust, via the driving plate 43, a user can rotate and align the outlet 42 of the cartridge body 40 with the passage 51. Referring to FIGS. 1 to 4, after the fan 2 is turned on, the external air is sucked through the ventilation hole 14 of the housing 1 and the second inlet 32 into the room 30 and filtered. Then the air is sucked through the hole 301 into the incoming compartment 11*a* of the chamber 11. Then the air flow created by the fan 2 makes the external air flow from the outgoing compartment 11*b* of the chamber 11, the outlet 33 of the guide shaft 330 and the inlet section 41 of the cartridge body 40 into the cartridge body 40. Then the air is blown outward from the outlet 42 and the passage 51 for blowing dust.

When used for sucking dust, via the driving plate 43, the user can rotate and align the guide hole 441 of the guide sleeve 44 with the passage 51 and the first inlet 31. At this time, the cartridge body 40 seals the second inlet 32. Referring to FIGS. 1, 2, 5 and 6, after the fan 2 is turned on, the external air and dust are sucked through the passage 51, the guide hole 441 and the first inlet 31 of the sleeve 3 into the dust collecting room 30. After filtered by the filter material 302, the clean air is sucked through the hole 301 of the room 30 into the incoming compartment 11*a* of the chamber 11. Then the air flows from the outgoing compartment 11*b* of the chamber 11 through the outlet 33 of the guide shaft 330 and the inlet section 41 of the cartridge body 40 into the cartridge body 40. Then the air flows from the outlet 42 through the ventilation hole 14 of the housing 1 to be exhausted to ambient atmosphere. Therefore, the user can suck the powders and dusts.

The dust sucking/blowing tube 5 includes a tube body 50. A first end of the tube body 50 is formed with a fitting section 5*a* for fitting into the fitting hole 13 of the housing 1. A second end of the tube body 50 is formed with a connector section 5*b* for connecting with a head section 50*a*. The tube body 50 is flexible, whereby it can be extended into a working position in a curved state. The head section 50*a* can be a conic body or the like without limitation.

Figure 7:
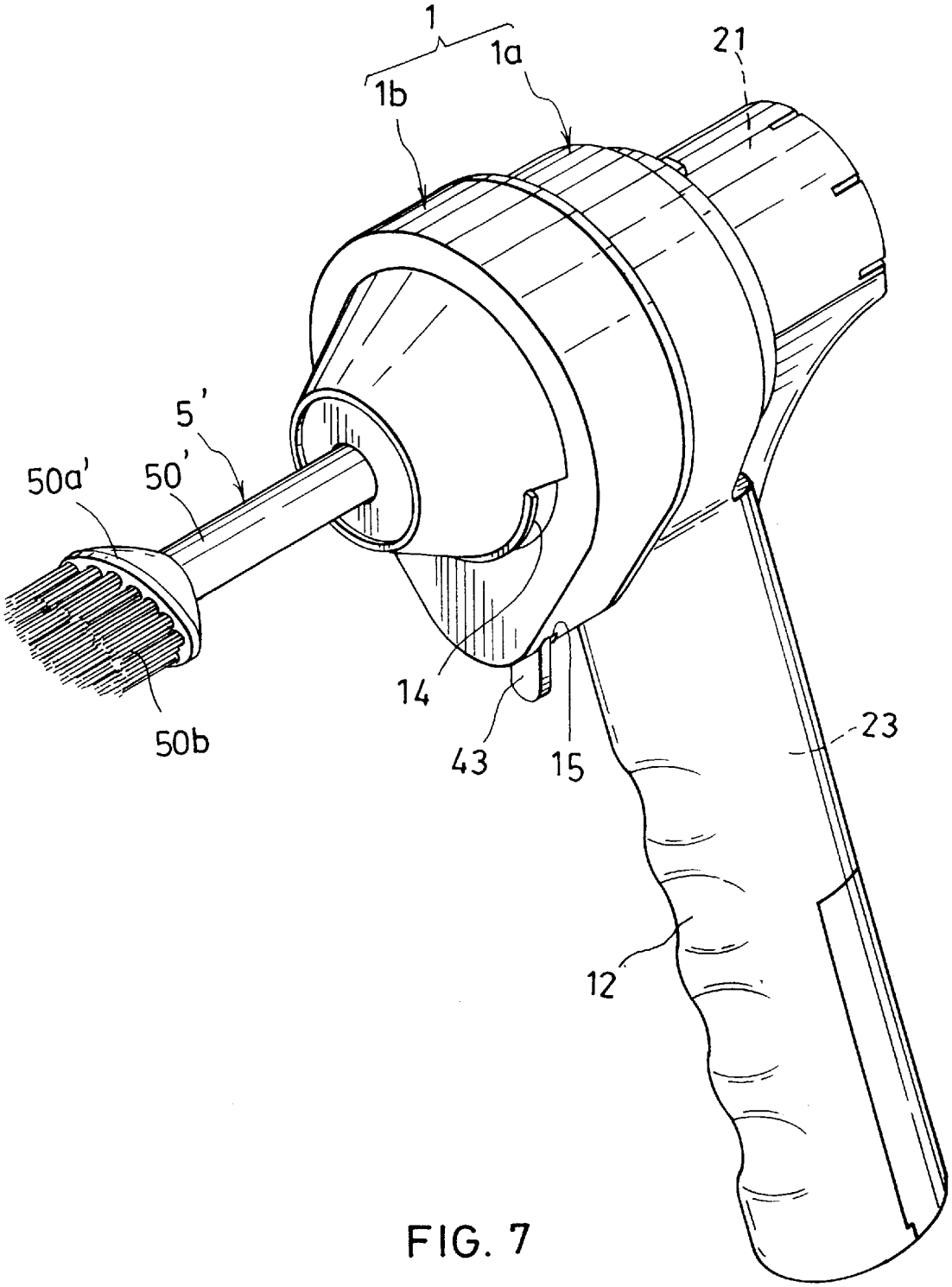
FIG. 7 shows another embodiment of the present invention.

As shown in FIG. 7, according to another embodiment of the present invention, the tube body 50' and head section 50*a*' of the dust sucking/blowing tube 5' can be integrally formed. Multiple brush hairs 50*b* can be disposed around the head section 50*a*' for brushing off the powders and dusts.

The present invention has the following advantages:

1. The device is switchable to serve to both suck and blow dusts as necessary.

2. The device has small volume and is easy to carry.

3. The device has simple structure and can be easily operated.

4. The device can be fitted with different dust sucking/blowing tube to meet the requirement of different application sites.

It is to be understood that the above description and drawings are only used for illustrating some embodiments of the present invention, not intended to limit the scope thereof. Any variation and derivation from the above description and drawings should be included in the scope of the present invention.

What is claimed is:

1. A dust sucking/blowing device comprising:

a housing including a first casing defining a fan chamber for receiving a fan therein and a second casing fitted with the first casing and formed with a fitting hole for receiving therein a dust sucking/blowing tube, the second casing being further formed with a ventilation hole for ventilating the housing;

a dust collecting sleeve disposed in the housing, an inner side of the sleeve being formed with a dust collecting room, a first side of the sleeve being fitted around the fan chamber, the room being formed with at least one perforation for communicating with the incoming compartment of the chamber, a second side of the sleeve being formed with a first inlet and a second inlet for communicating with the room, the sleeve being formed with an outlet for communicating with the outgoing compartment of the fan chamber; and a control guide cartridge including a hollow cartridge body formed with an inlet section fitted with the outlet of the sleeve for guiding air flow into the cartridge body, and an outlet for outward guiding the air flow from the cartridge body, the guide cartridge further including a driving plate one end of which is connected with the cartridge body and the other end of which is passed through and out of a slide slot of the housing, a guide sleeve being connected with a lateral edge of the cartridge body and formed with a guide hole, when the outlet of the cartridge body being aligned with the fitting hole of the second casing, the outlet of the cartridge body permits the air flow from the fan to be outward blown from the passage of the dust sucking/blowing tube fitted with the fitting hole for blowing away dusts, when the guide sleeve is aligned with the first inlet of the sleeve land the fitting hole of the second casing, the first end of the cartridge body sealing the second inlet, whereby the first inlet is communicated with the passage of the dust sucking/blowing tube via the guide hole of the guide sleeve and the external dusts and impurities are sucked through the passage, guide sleeve and the first inlet into the room.

2. A dust sucking/blowing device as claimed in claim 1, wherein the housing includes a first casing defining the fan chamber and having a downward extending handle, and a second casing fitted with the first casing and formed with a fitting hole for receiving therein the dust sucking/blowing tube, the second casing being further formed with a ventilation hole for ventilating the housing.

3. A dust sucking/blowing device as claimed in claim 1, wherein the dust collecting sleeve includes a sleeve section having a first end fitted around the chamber for enclosing the fan and a second end formed with a dust collecting room, an inner side of the room being disposed with a side wall for isolating the room and the chamber, the side wall being formed with at least one perforation for communicating with the incoming section of the chamber, a filter material being disposed over the perforation for filtering the dust and impurities sucked into the room, the outer side of the room being formed with a through hole aligned with and communicating with the outgoing section of the chamber, the sleeve further including a cover body having a first side formed with a fitting cavity for fitting with the outer exit of the room, the cover body being formed with a first inlet and a second inlet for communicating with the chamber, the first inlet being axially aligned with the fitting hole of the second casing, an air exhausting guide shaft projecting from a lateral side of the cover body to axially pass through an outlet and fit into the through hole of the sleeve section for outward guiding the air flow from the outgoing section.

4. A dust sucking/blowing device as claimed in claim 3, wherein the side wall of the sleeve section is disposed with multiple ribs over which the filter material is disposed.

5. A dust sucking/blowing device as claimed in claim 1, wherein the cover body of the dust collecting sleeve is disposed with a first locating stopper block and a second locating stopper block, whereby when the guide cartridge abuts against the first locating stopper block, the outlet of the guide cartridge is aligned with the passage of the dust sucking/blowing tube, and when the guide cartridge abuts against the second locating stopper block, the cartridge body seals the second inlet of the sleeve and the guide hole of the guide sleeve is aligned with the passage and the second inlet as well as the first inlet in a dust sucking state.

* * * * *